United States Patent [19]

Takajo

[11] Patent Number: 4,561,893

[45] Date of Patent: Dec. 31, 1985

[54] ALLOY STEEL POWDER FOR HIGH STRENGTH SINTERED PARTS

[75] Inventor: Shigeaki Takajo, Chiba, Japan

[73] Assignee: Kawasaki Steel Corporation, Kobe, Japan

[21] Appl. No.: 654,369

[22] Filed: Sep. 25, 1984

[30] Foreign Application Priority Data

Sep. 29, 1983 [JP] Japan ..... 58-179211

[51] Int. Cl.[4] ..... C22C 38/16

[52] U.S. Cl. ..... 75/251; 75/255; 75/125

[58] Field of Search ..... 75/255, 251, 125

[56] References Cited

U.S. PATENT DOCUMENTS

| | | | |
|---|---|---|---|
| 3,901,661 | 8/1975 | Kondo et al. | 29/182 |
| 4,049,429 | 9/1977 | Donachie | 75/296 |
| 4,069,044 | 1/1978 | Mocarski et al. | 75/243 |
| 4,126,452 | 11/1978 | Tengzelius et al. | 75/251 |
| 4,236,945 | 12/1980 | Reen | 198/105 |
| 4,437,891 | 3/1984 | Umino | 75/251 |

FOREIGN PATENT DOCUMENTS

| | | | |
|---|---|---|---|
| 2749215 | 5/1978 | Fed. Rep. of Germany | 75/255 |
| 2035376 | 6/1980 | United Kingdom | 75/251 |

*Primary Examiner*—Christopher W. Brody

*Attorney, Agent, or Firm*—Balogh, Osann, Kramer, Dvorak, Genova & Traub

[57] ABSTRACT

An alloy steel powder for high strength sintered parts consisting essentially of 0.4–1.3% by weight of Ni, 0.2–0.5% by weight of Cu, the total amount of Ni and Cu being 0.6–1.5% by weight, 0.1–0.3% by weight of Mo and the remainder being not more than 0.02% by weight of C, not more than 0.1% by weight of Si, not more than 0.3% by weight of Mn and not more than 0.01% by weight of N respectively in the incidental mixed amount and substantially Fe. The alloy steel powder may be a mixture of the alloy steel powder with ferro-phosphorus powder in an amount of phosphorus in the total fixed powder of 0.05–0.6% by weight.

2 Claims, 3 Drawing Figures

ALLOY STEEL POWDER FOR HIGH STRENGTH SINTERED PARTS

BACKGROUND OF THE INVENTION

1. Field of the Invention

The present invention relates to an alloy steel powder for high strength sintered parts and particularly to an alloy steel powder which is inexpensive and advantageously develops the high strength as raw material steel powder for sintered machine parts.

2. Description of the Prior Art

As is well known, the applicable field of sintered parts has been broadened owing to the progress of the powder metallurgical technique and therefore an alloy steel powder has been used as raw material powder in addition to pure iron powder. This alloy steel powder is usually produced by water atomization followed by finish-reduction and the development of such an alloy steel powder can firstly provide high strength sintered parts, the production of which has been difficult in the prior process wherein alloy elements are added and mixed with pure iron powder.

The basic requirements for such an alloy steel powder are summarized in the following points:

(1) Raw material powder is inexpensive.

(2) Compressibility is excellent when compacting the parts.

(3) A specific atomsphere is not necessary when sintering the parts.

(4) Mechanical strength of the sintered body is high.

Heretofore, the development of steel powder has been advanced by aiming at the points (3) and (4) among the above described requirements and alloy steel powders, such as 2Ni-0.5Mo, 1.5Ni-0.5Cu-0.5Mo and the like have been proposed. However, these alloy steel powders are relatively high in alloy element amount, so that the cost of the raw material is high and the steel powders become hard. Therefore, such alloy steel powders are not fully satisfactory with respect to the points (1) and (2) among the above described requirements.

The prior alloy steel powders need forging after sintering in most of the cases, that is, should be subjected to so-called "powder forging", therefore in the field where a sintered article is directly used without carrying out the hot compacting, a development of novel alloy has been considered to be necessary.

SUMMARY OF THE INVENTION

The inventor has expended great efforts on the development of alloy steel powders which satisfy all the above described four requirements and accomplished the present invention.

The first aspect of the invention lies in an alloy steel powder for high strength sintered parts consisting essentially of 0.4–1.3% by weight (shown by merely "%" hereinafter) of Ni, 0.2–0.5% of Cu, the total amount of Ni and Cu being 0.6–1.5%, 0.1–0.3% of Mo and the remainder being not more than 0.02% of C, not more than 0.1% of Si, not more than 0.3% of Mn and not more than 0.01% of N respectively in the incidental mixed amount and substantially Fe.

The second aspect of the invention lies in an alloy steel powder for high strength sintered parts, which is a mixture of the above described alloy steel powder with ferro-phosphorus powder, phosphorus content in the total mixed powder being 0.05–0.6%.

The first aspect of the invention provides particularly excellent properties when the sintered body is used after said body is heat-treated, while the alloy steel powder of the second aspect of the invention is advantageously used when the sintered body is directly used.

DESCRIPTION OF THE PREFERRED EMBODIMENTS

Figure 1:
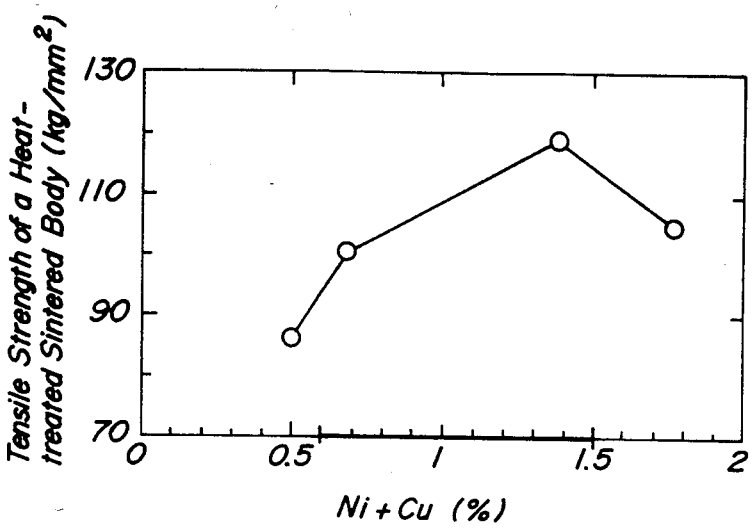
FIG. 1 is a graph illustrating the relation between the total amount of Ni and Cu contained in a steel powder and the tensile strength of the heat-treated sintered body.

Explanation will be made with respect to the reason why the composition of the components is limited as described above.

Ni: 0.4–1.3%, Cu: 0.2–0.5%, Ni+Cu: 0.6–1.5%

Both Ni and Cu effectively contribute to the strengthening of the sintered body by formation of a solid solution in Fe base. However, if the total amount is less than 0.6%, the activity thereof is poor, so that said amount must be at least 0.6% and when the total amount is limited within 1.5%, the deterioration of compressibility due to hardening of steel powder owing to the addition of alloy elements can be restrained to the minimum limit, so that the total amount of Ni and Cu is limited within the range of 0.6–1.5%. In this case, as the additive element, Cu is cheaper than Ni, so that it is advantageous to positively add Cu as far as possible in the same total amount of Ni and Cu and the amount of Ni is reduced. Namely, if Cu content is not less than 0.2%, Cu can be used in place of Ni without influencing upon the properties, so that it is advantageous to use Cu in place of Ni. But if the amount of Cu used in place of Ni exceeds 0.5%, the strength of the sintered body is noticeably lowered and such an amount is not preferable and Cu is limited within the range of 0.2–0.5%.

Ni is more expensive than Cu but is a useful element for improving the toughness of the sintered body and the lower limit of Ni is 0.4 considering the activity of said element. From the above described requirements of the upper limit of Ni+Cu of 1.5% and the lower limit of Cu of 0.2%, the upper limit of Ni is 1.3%.

Mo: 0.1–0.3%

Mo is an essential element, because this element strengthens the sintered body through the formation of the solid solution in Fe base and forms a hard carbide and improves the strength and hardness of the sintered body and further improves the quenching ability. The added amount needs at least 0.1% considering the activity, while if said amount exceeds 0.3%, such an amount is not preferable in view of the compressibility and the cost of the raw material, so that the range of Mo content is limited to 0.1–0.3%.

C: not more than 0.02%, N: not more than 0.01%

Both C and N adversely affect the compressibility of the steel powder, so that it is desirable to restrict these amounts as low as possible but the degrees of not more than 0.02% of C and not more than 0.01% of N are acceptable.

Si: not more than 0.1%

Si adversely affects the compressibility of the steel powder and is readily preferentially oxidized when the sintering is carried out with a cheap dissociated hydrocarbon gas (RX gas) etc. and affects noticeably adversely the sintered body, so that Si amount is limited to not more than 0.1%.

Mn: not more than 0.3%

Mn has been generally known as an element for improving the quenching ability but is readily preferentially oxidized when the sintering is carried out with a cheap dissociated hydrocarbon gas (RX gas) in powder metallurgy and adversely affects the strength of the sintered body, so that the amount of Mn is limited to not more than 0.3% in the present invention.

By satisfying the above described composition ranges of the components, the excellent alloy steel powder satisfying all the above described four requirements can be obtained. That is, the alloy steel powders according to the present invention are fairly lower than the prior alloy steel powders in the ratio of the alloy amount occupied, so that the alloy steel powders are excellent in the cost of the steel powder and the compressibility and as seen from the example described hereinafter, any specific atmosphere is not necessary when sintering and the strength and toughness of the sintered body after heat treatment are far more improved than the cases where the prior alloy steel powders are used.

In the sintered parts, some part is used directly without carrying out the heat treatment after the sintering. In such a case, it has been found that the strength is very effectively improved by mixing a small amount of ferro-phosphorus powder to the alloy steel powder having the above described composition. That is, it has been found that the sintering strength higher than the alloy steel powder having a large amount of alloy elements as in the prior alloy steel owders, can be obtained at a lower cost by using a mixed powder in which ferro-phosphorus powder is mixed with the alloy steel powder having the above described composition in an amount of 0.05–0.6% based on the total powder.

The reason why P is not previously added as the alloy component but is added now in the form of ferro-phosphorus powder, is as follows. Namely, if P is previously contained as an alloy component, the steel powder becomes hard and the compressibility is lowered and if phosphorus powder is added alone, the oxidation is readily caused upon sintering in RX gas.

The addition of P in the form of ferro-phosphorus powder provides the solid solution in Fe base to strengthen the sintered body and has a function by which the pores in the sintered body are made spherical, and contributes to improve the toughness. However, if the content of P is less than 0.05% based on the total amount of the mixed powder, the addition effect is poor, while even if said content exceeds 0.6%, the effect proportional to the increase of the added amount cannot be obtained and further phosphorus precipitates in the grain boundary and the toughness is rather deteriorated, so that the content of P is limited within the range of 0.05–0.6%.

The following example is given for the purpose of illustration of this invention and is not a limitation theeof.

Molten steels were produced so as to obtain steel powders (No. 1 and No. 2) according to the present invention and a conventional steel powder (No. 3), which steel powders had a composition shown in the following Table 1. While each of the molten steels was flowed out through a nozzle of a tundish, the molten steel was atomized with a pressurized water of 150 kg/cm$^2$. The atomized steel powder was dehydrated and dried, and then the dried steel powder was finally reduced at 1,000° C. for 90 minutes in a dissociated ammonia gas. The resulting cake was pulverized by means of a hammer mill, and the pulverized steel powder was sieved to obtain a powder having a particle size of not larger than the 80 mesh sieve opening. The resulting powder had a property shown in the following Table 2.

TABLE 1

| | Chemical composition of steel powder (% by weight) | | | | | | |
|---|---|---|---|---|---|---|---|
| | C | Si | Mn | Ni | Cu | Mo | N |
| Steel powder of this invention (No. 1) | 0.011 | 0.057 | 0.21 | 0.69 | 0.43 | 0.26 | 0.003 |
| Steel powder of this invention (No. 2) | 0.008 | 0.007 | 0.08 | 1.08 | 0.31 | 0.19 | 0.001 |
| Conventional steel powder (No. 3) | 0.008 | 0.011 | 0.34 | 1.53 | 0.53 | 0.51 | 0.002 |

TABLE 2

| | Properties of powder | | | | | | | |
|---|---|---|---|---|---|---|---|---|
| | | Particle size distribution (%) | | | | | | |
| Steel powder | Apparent density (g/cm$^3$) | +80 meshes | 80/100 meshes | 100/150 meshes | 150/200 meshes | 200/250 meshes | 250/325 meshes | −325 meshes |
| Steel powder of this invention (No. 1) | 3.01 | 0.2 | 7.9 | 25.2 | 18.8 | 10.9 | 18.4 | 20.6 |
| Steel powder of this invention (No. 2) | 2.97 | 0.2 | 4.5 | 22.0 | 20.2 | 13.6 | 20.9 | 18.6 |
| Conventional steel powder (No. 3) | 2.99 | 0.2 | 9.3 | 26.9 | 20.4 | 10.3 | 16.1 | 16.8 |

Each of the steel powders shown in Table 2 was used as a raw material, and a sintered body was produced in the following manner.

To each steel powder were added 0.5% by weight of graphite powder and 1.0% by weight of zinc stearate, and the resulting mixture was compacted under a pressure of 6 t/cm$^2$ to produce a green compact. The resulting green compact was then heated at 600° C. for 30 minutes in an RX gas to volatilize the zinc stearate, and then sintered at 1,150° C. for 60 minutes in the same RX gas as described above. Successively, the resulting sintered body was heated at 800° C. for 30 minutes in an Ar gas, quenched in oil kept at 60° C. and then tempered at 170° C. for 90 minutes.

The following Table 3 shows the green density and the mechanical properties of the heat-treated sintered body in each steel powder.

TABLE 3

| Steel powder | Green compact Green density ($g/cm^3$) | Heat-treated sintered body Tensile strength ($kg/mm^2$) | Charpy impact value* ($kg \cdot m/cm^2$) |
|---|---|---|---|
| Steel powder of this invention (No. 1) | 6.94 | 102 | 1.9 |
| Steel powder of this invention (No. 2) | 6.98 | 119 | 1.9 |
| Conventional steel powder (No. 3) | 6.86 | 103 | 1.6 |

*No notch

It can be seen from Table 3 that the alloy steel powder of the present invention is superior to conventional alloy steel powder in compressibility of the powder itself and in strength and toughness of the heat-treated sintered body. Moreover, the alloy steel powder of the present invention can be produced very inexpensively in view of its alloy composition. Therefore, the present invention is a very effective invention.

In order to illustrate more clearly the relation between the alloyed amounts of Ni, Cu and Mo and the strength of a heat-treated sintered body, alloy steel powders A–J having a chemical composition shown in the following Table 4 with respect to Ni, Cu and Mo were produced in the same manner as described above. In all the alloy steel powders A–J, the chemical composition, in % by weight, for components other than Ni, Cu and Mo was as follows: C: 0.003–0.009%, Si: 0.006–0.010%, Mn: 0.05–0.11% and N: ≦0.0015%. The steel powders were compacted, sintered and heat-treated in the same manner as described above. The tensile strength of the heat-treated sintered bodies are shown in Table 4. In Table 4, steel powders indicated by the mark (*) are those of the present invention.

TABLE 4

| Steel Powder | Chemical composition (% by weight) Ni | Cu | Mo | Ni + Cu | Ni/Cu (weight) ratio | Tensile strength of a heat-treated sintered body ($kg/mm^2$) |
|---|---|---|---|---|---|---|
| A | 0.38 | 0.12 | 0.18 | 0.50 | 3.2 | 87 |
| B* | 0.48 | 0.21 | 0.20 | 0.69 | 2.3 | 101 |
| C* | 1.08 | 0.31 | 0.19 | 1.39 | 3.5 | 119 |
| D | 1.39 | 0.39 | 0.22 | 1.78 | 3.6 | 105 |
| E | 0.79 | 0.59 | 0.19 | 1.38 | 1.3 | 104 |
| F* | 0.85 | 0.43 | 0.21 | 1.28 | 2.0 | 113 |
| G | 1.17 | 0.13 | 0.22 | 1.30 | 9.0 | 117 |
| H | 1.02 | 0.28 | 0.05 | 1.30 | 3.6 | 89 |
| I* | 0.98 | 0.28 | 0.11 | 1.26 | 3.5 | 105 |
| J | 0.93 | 0.32 | 0.36 | 1.25 | 2.9 | 111 |

*Steel powder of the present invention.

Steel powders A, B, C and D contain about 0.2% of Mo and a variant total amount of Ni and Cu under a condition of Ni/Cu ratio of about 3. FIG. 1 is a graph illustrating the relation between the total amount of Ni and Cu contained in a steel powder and the tensile strength of the heat-treated sintered body. It can be seen from FIG. 1 that, when the total amount of Ni and Cu is less than 0.6%, the strength decreases noticeably. While, even when the total amount is more than 1.5%, the strength does not improve but rather decreases due to the lowering of the compressibility of the steel powder.

Figure 2:
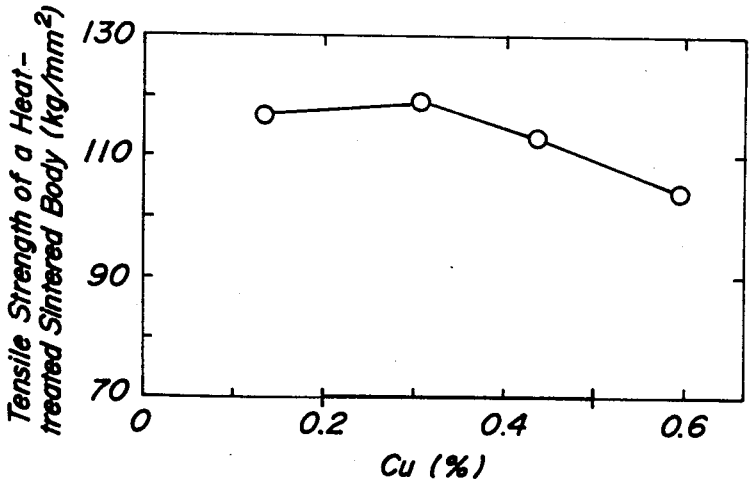
FIG. 2 is a graph illustrating the relation between the Cu content in a steel powder and the tensile strength of the heat-treated sintered body.

Steel powders G, C, F and E contain about 0.2% of Mo and a variant amount of Cu under a condition of the total amount of Ni and Cu of about 1.3. FIG. 2 illustrates the relation between the Cu content in a steel powder and the tensile strength of the heat-treated sintered body. It can be seen from FIG. 2 that, when the Cu content is up to about 0.3%, Cu can be replaced by Ni without an adverse affect on the strength, but when the Cu content exceeds 0.4%, the strength of the heat-treated sintered body decreases. It can be judged from this result that the Cu content within the range of 0.2–0.5% is effective for obtaining inexpensively a sintered body having excellent properties.

Figure 3:
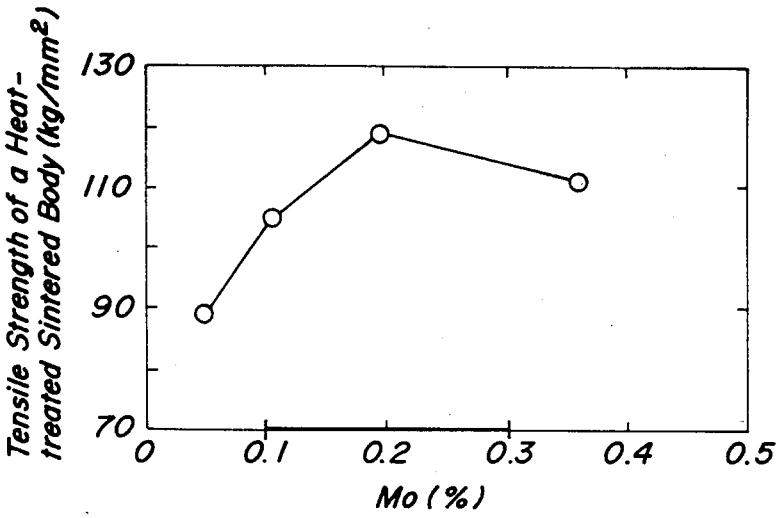
FIG. 3 is a graph illustrating the relation between the Mo content in a steel powder and the tensile strength of the heat-treated sintered body.

Steel powders H, I, C and J contain about 1% of Ni and a variant amount of Mo under a condition of the amount of Cu of about 0.3%. FIG. 3 illustrates the relation between the Mo content in a steel powder and the tensile stength of the heat-treated sintered body. It can be clearly seen from FIG. 3 that, when the Mo content is less than 0.1%, the strength decreases noticeably, and when the Mo content exceeds 0.3%, the strength rather decreases.

Ferro-phosphorus powder having a particle size of −325 meshes and having a P content of 27% was added to the alloy steel powder of No. 2 shown in the above Tables 1 and 2 to produce an alloy steel powder of No. 4 having a P content of 0.4%. The alloy steel powder of No. 4 was mixed with graphite powder and zinc stearate, and then compacted and sintered in the same manner as described in the above described experiment to obtain a sintered body.

The following Table 5 shows the density of the green compact and the mechanical properties of the sintered body before heat-treatment. For comparison, the conventional steel powder of No. 3 was treated in the same manner as described above, and the density of the green compact and the mechanical properties of the sintered body before heat-treatment, are also shown in Table 5.

TABLE 5

| Steel powder | Green compact Green density ($g/cm^3$) | Sintered body (before heat-treatment) Tensile strength ($kg/mm^2$) | Charpy impact value* ($kg \cdot m/cm^2$) |
|---|---|---|---|
| Steel powder of this invention (No. 4) | 6.95 | 47 | 2.6 |
| Steel powder obtained from conventional steel powder of No. 3 | 6.87 | 45 | 2.0 |

*No notch

It can be seen from Table 5 that, when ferro-phosphorus powder is added to the steel powder of the present invention, the resulting steel powder (No. 4, steel powder of the present invention) has a high compressibility in itself and further is superior in strength and toughness in the sintered body before heat-treatment, to a steel powder produced from the conventional steel powder of No. 3 by adding ferro-phosphorus powder thereto.

In order to illustrate more clearly the influence of the addition amount of ferro-phosphorus powder, the relation between the addition amount of ferro-phosphorus powder to a steel powder and the tensile strength of the sintered body before heat-treatment, was examined by changing only the addition amount of ferro-phosphorus powder under the same condition. The following Table 6 shows the results. It can be seen from Table 6 that the effect of ferro-phosphorus powder for improving the strength appears in the addition amount of P: 0.1–0.6%.

TABLE 6

| Addition amount of P (wt %) | Tensile strength of a sintered body before heat-treatment ($kg/mm^2$) |
|---|---|
| 0 | 35 |
| 0.1* | 41 |
| 0.2* | 44 |
| 0.4* | 47 |
| 0.6* | 43 |
| 0.8 | 34 |

*Steel powder of the present invention (mixed with ferrophosphorus powder)

As described above, according to the present invention, an alloy steel powder which satisfies all the above described four requirements in the raw steel powder for the production of a sintered body having a high strength can be produced very advantageously.

What is claimed is:

1. An alloy steel powder for high strength sintered parts consisting essentially of 0.4–1.3% by weight of Ni, 0.2–0.5% by weight of Cu, the total amount of Ni and Cu being 0.6–1.5% by weight, 0.1–0.3% by weight of Mo and the remainder being not more than 0.02% by weight of C, not more than 0.1% by weight of Si, less than 0.3% by weight of Mn and not more than 0.01% by weight of N respectively in the incidental mixed amount and substantially Fe.

2. An alloy steel powder as claimed in claim 1, wherein the alloy steel powder is a mixture of the alloy steel powder with ferro-phosphorous powder in an amount of phosphorus in the total mixed powder of 0.05–0.6% by weight.

* * * * *